US006789381B2

(12) United States Patent
Irmen et al.

(10) Patent No.: US 6,789,381 B2
(45) Date of Patent: Sep. 14, 2004

(54) YARN SPLICING DEVICE

(75) Inventors: Wolfgang Irmen, Mönchengladbach (DE); Bernhard Schmitz, Willich (DE); Norbert Corres, Wegberg (DE)

(73) Assignee: W. Schlafhorst AG & Co. (DE)

( * ) Notice: Subject to any disclaimer, the term of this patent is extended or adjusted under 35 U.S.C. 154(b) by 89 days.

(21) Appl. No.: 10/268,451

(22) Filed: Oct. 10, 2002

(65) Prior Publication Data

US 2003/0070410 A1 Apr. 17, 2003

(30) Foreign Application Priority Data

Oct. 12, 2001 (DE) ..... 101 50 591

(51) Int. Cl.[7] ..... B65H 69/06
(52) U.S. Cl. ..... 57/22; 057/202
(58) Field of Search ..... 57/22, 23, 202; 28/141; 156/49; 242/475.1, 475.2, 475.3, 475.4, 475.5, 475.6, 555, 555.6, 556

(56) References Cited

U.S. PATENT DOCUMENTS 3,345,809 A 10/1967 Gemeinhardt et al. ..... 57/22
4,032,382 A * 6/1977 Obeda ..... 156/73.2
4,452,035 A * 6/1984 Rohner et al. ..... 57/22
4,813,220 A * 3/1989 Isern ..... 57/22
2001/0003894 A1 * 6/2001 Premi ..... 57/22

FOREIGN PATENT DOCUMENTS

| | | | |
|---|---|---|---|
| CH | 439 168 | | 6/1967 |
| DE | 1 535 828 | * | 10/1969 |
| DE | 27 50 593 | * | 5/1978 |
| DE | 30 40 661 A1 | * | 5/1982 |
| DE | 31 14 538 A1 | | 1/1983 |
| DE | 83 33 628 | | 8/1988 |
| DE | 39 35 536 A1 | * | 5/1991 |

OTHER PUBLICATIONS

German Search Report*
European Search Report.

* cited by examiner

*Primary Examiner*—John J. Calvert
*Assistant Examiner*—Shaun R Hurley
(74) *Attorney, Agent, or Firm*—Kennedy Covington Lobdell & Hickman, LLP

(57) ABSTRACT

A yarn splicing device with a splicing channel that can be charged with compressed air for the pneumatic connection of two yarn ends. The yarn splicing device has two rotatably seated prism elements, each of which is pivotable between a non-splicing position and a splicing position. The two prism elements are designed such that in the splicing position, a splicing channel is formed between them.

8 Claims, 5 Drawing Sheets

YARN SPLICING DEVICE

CROSS REFERENCES TO RELATED APPLICATIONS

This application claims the benefit of German patent application 101 50 591.4, filed Oct. 12, 2001, herein incorporated by reference.

FIELD OF THE INVENTION

The present invention generally relates to a yarn splicing device.

BACKGROUND OF THE INVENTION

Yarn splicing devices for the pneumatic connection of two yarn ends have been known for a long while in connection with automatic cheese winders.

Yarn splicing devices are known, wherein the yarn insertion slot of a splicing channel arranged in a so-called splicing head remains uncovered during the splicing process, as well as splicing devices wherein this yarn insertion slot is closed by a special cover element during the splicing process.

For example, German Patent Publication DE 39 35 536 C2 discloses a yarn splicing device having a splicing head whose splicing channel has an approximately circular cross section. Compressed air injection openings terminate tangentially in the splicing channel. Moreover, on its top the splicing channel has a continuous slot, through which the yarn ends to be spliced together can be threaded. This yarn insertion slot can be closed by means of a cover element during the splicing process.

Basically, such yarn splicing devices with or without cover elements have proven themselves in actual use.

However, difficulties in inserting the yarn end into the splicing channel occasionally arise in connection with splicing devices without covers, since with these yarn splicing devices the yarn insertion slit is usually laid out relatively narrowly.

Yarn splicing devices whose splicing channel can be closed by means of a pivotably seated cover element have the disadvantage that such devices are often relatively bulky, i.e. such yarn splicing devices require a relatively large installation space.

SUMMARY OF THE INVENTION

It is accordingly an object of the present invention to create a yarn splicing device that overcomes the aforesaid disadvantages.

This object is addressed by a yarn splicing device comprising a splicing channel that can be charged with compressed air for the pneumatic connection of two yarn ends, wherein the yarn splicing device has two rotatably seated prism elements that are each pivotable between a yarn reception position and a splicing position such that in the splicing position a splicing channel is formed that can be charged with compressed air between the prism elements.

An advantage of the yarn splicing device of the present invention is that it is extremely compact in its construction. Furthermore, the yarn ends to be spliced together can be positioned without problems in the area of the splicing channel. Thus, because of the employment of two rotatably seated prism elements it is possible to simply securely position the yarn ends that have been preplaced by a suction nozzle or a gripper tube inside the splicing channel and to fix them in place there for the splicing process.

In one embodiment of the present invention, at least one of the prism elements has a compressed air injection opening.

Such a compressed air injection opening makes the directed injection of splicing air into the splicing channel formed by the prism element possible, such that the prism element without a compressed air injection opening acts as the cover element.

In another embodiment of the present invention, an air distribution channel is cut into a respective prism element. Preferably, two compressed air injection openings branch from the air distribution channel and terminate in the splicing channel. Splicing air can be blown into the splicing channel via the air distribution channel and the compressed air injection openings. This splicing air provides the mutual swirling together of the yarn ends positioned in the splicing channel, whose spinning twist had previously been removed to the greatest extent possible.

Thus, it is possible to produce dependable and lasting yarn connections.

In yet another embodiment of the present invention, the compressed air injection openings each terminate tangentially in the splicing channel.

The tangential arrangement of the injection openings assures that an at least partially rotating air flow is created inside the splicing channel.

Such a rotating air flow results in solid, almost finished yarn-like yarn connections.

In still yet another embodiment of the present invention, the two prism elements are identical and each has a compressed air injection opening.

By using identical components it is possible to make the production costs of these parts relatively advantageous, yet if these parts are produced as injection-molded or die-cast parts, storage is also simplified.

In another embodiment of the present invention, the prism elements each comprise an approximately cylindrical prism body and a releasable rear cover element.

Thus, the prism bodies are designed such that in the yarn pickup position there is sufficient space provided between the prism bodies for inserting the yarn that is to be spliced together.

In the splicing position, the prism bodies rest against the opposite prism body such that a splicing channel that is closed to the greatest extent is formed between the prism bodies.

In yet another embodiment of the present invention, the rear cover elements that can be fixed in place on the prism elements, each have a convexly rounded sealing surface into which an air connection bore has been cut.

Each of these convexly rounded sealing surfaces of the cover elements matches correspondingly concavely arched sealing surfaces of a stationary connecting means which can be charged with compressed air.

Thus, the connecting means are connected with a compressed air source via a pneumatic line into which an electromagnetic valve, for example, has been inserted so that it is possible by means of an appropriate control of the electromagnetic valve to blow splicing air in a directed manner into the splicing channel. For example, over the length of time the electromagnetic valve is open it is possible to match the effect of the splicing air individually to the respective material or the thickness of the yarn ends to be spliced together.

In still yet another embodiment of the present invention, the prism elements are seated, pivotable to a limited extent, in a base body of the yarn splicing device.

Driving of the prism elements takes place advantageously here by means of a drive mechanism, for example a step motor that can be controlled by means of a work station computer.

Such step motors are commercially available, cost-effective mass-produced components that have been tested in various fields of employment and have proven to be dependable and have a long service life.

Further details of the present invention can be gathered from a non-limiting exemplary embodiment presented in the following description with reference made to the drawings.

DESCRIPTION OF THE PREFERRED EMBODIMENT

Figure 1:
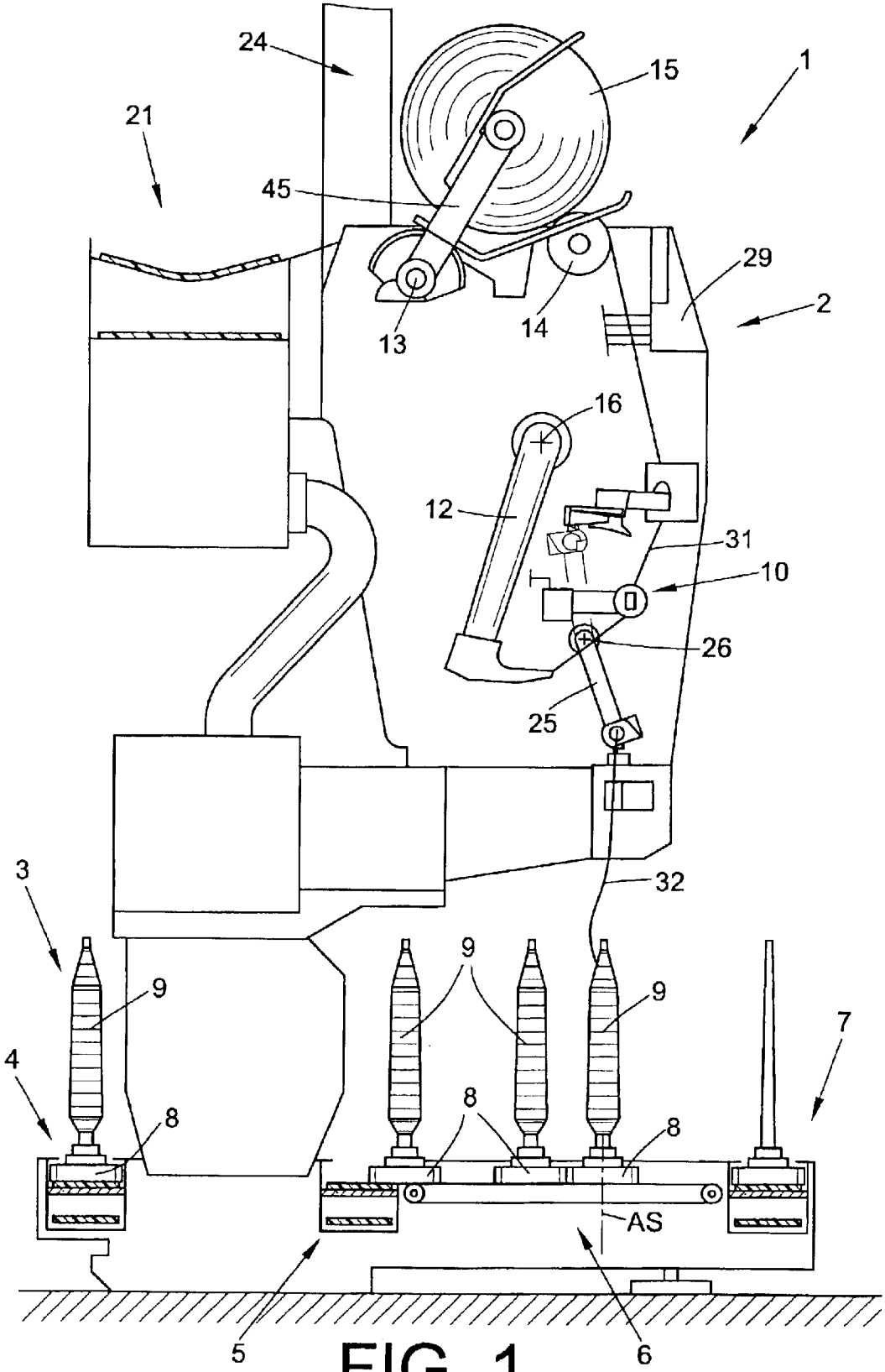
FIG. 1 is a lateral view of a work station of a cheese-producing textile machine with a splicing device in accordance with the present invention.

A cheese-producing textile machine, in particular an automatic cheese winder, is identified by the reference numeral 1 in FIG. 1.

Automatic cheese winders typically have a plurality of identical work stations. In the present embodiment, there are winding stations 2 between their end frames (not shown).

In a known manner, the spinning cops 9 produced on a ring spinning machine are rewound in these winding stations 2 into large-volume cheeses 15. When finished, these cheeses 15 are transferred by means of an automatically operating service unit, preferably a cheese changer (not shown), to a cheese transport device 21 extending the length of the machine and are conveyed to a bobbin loading station or the like arranged at the end of the machine.

Such automatic cheese winders 1, moreover, have a logistic arrangement in the form of a bobbin and tube transport system 3. The spinning cops, or empty tubes, circulate on transport disks 8 in this bobbin and tube transport system 3.

Only the cop feed track 4, the reversibly driveable storage track 5, one of the transverse transport tracks 6 leading to the winding stations 2, as well as the tube return track 7, of the bobbin and tube transport system 3 are represented in FIG. 1.

As already indicated above, the delivered spinning cops 9 are rewound into large-volume cheeses in the unwinding stations AS, each of which is located at the winding stations 2 in the area of the transverse transport tracks 6. In a known manner, the individual winding stations have various devices for this purpose, which assure the orderly operation of these work stations. These devices are, for example, a suction nozzle 12, a gripper tube 25, and a yarn splicing device 10. In this case, the yarn splicing device 10 is preferably designed as a pneumatic splicer.

Furthermore, such winding stations have other devices, not shown in detail, such as a yarn cleaner, a waxing device, a yarn cutting device, a yarn tension sensor, and a bottom thread sensor.

Moreover, such an automatic cheese winder 1 customarily has a central control unit (not shown) that is connected via a machine bus with the separate work station computers 29 of the individual winding stations 2, as well as with a control device of the service unit.

In this case, the winding of the cheeses 5 takes place on so-called winding devices 24. These winding devices 24 have a creel 45 that is seated, movably around a pivot shaft 13, and a device for the rotatable holding of the cheese bobbins. During the winding process, the cheese 15 that is seated freely rotatable in the creel, rests with its surface on a driven grooved drum 14 and is taken along by the latter by means of a frictional connection.

As already briefly mentioned above, each work station 2 has a suction nozzle 12, and a gripper tube 25. The suction nozzle 12 that retrieves the top yarn from the cheese 15 and inserts it into the yarn splicing device 10 is pivotable in a limited manner around a rotary shaft 16.

The gripper tube 25 for manipulating the bottom yarn 32 can be pivoted around a rotary shaft 26.

Figure 2:
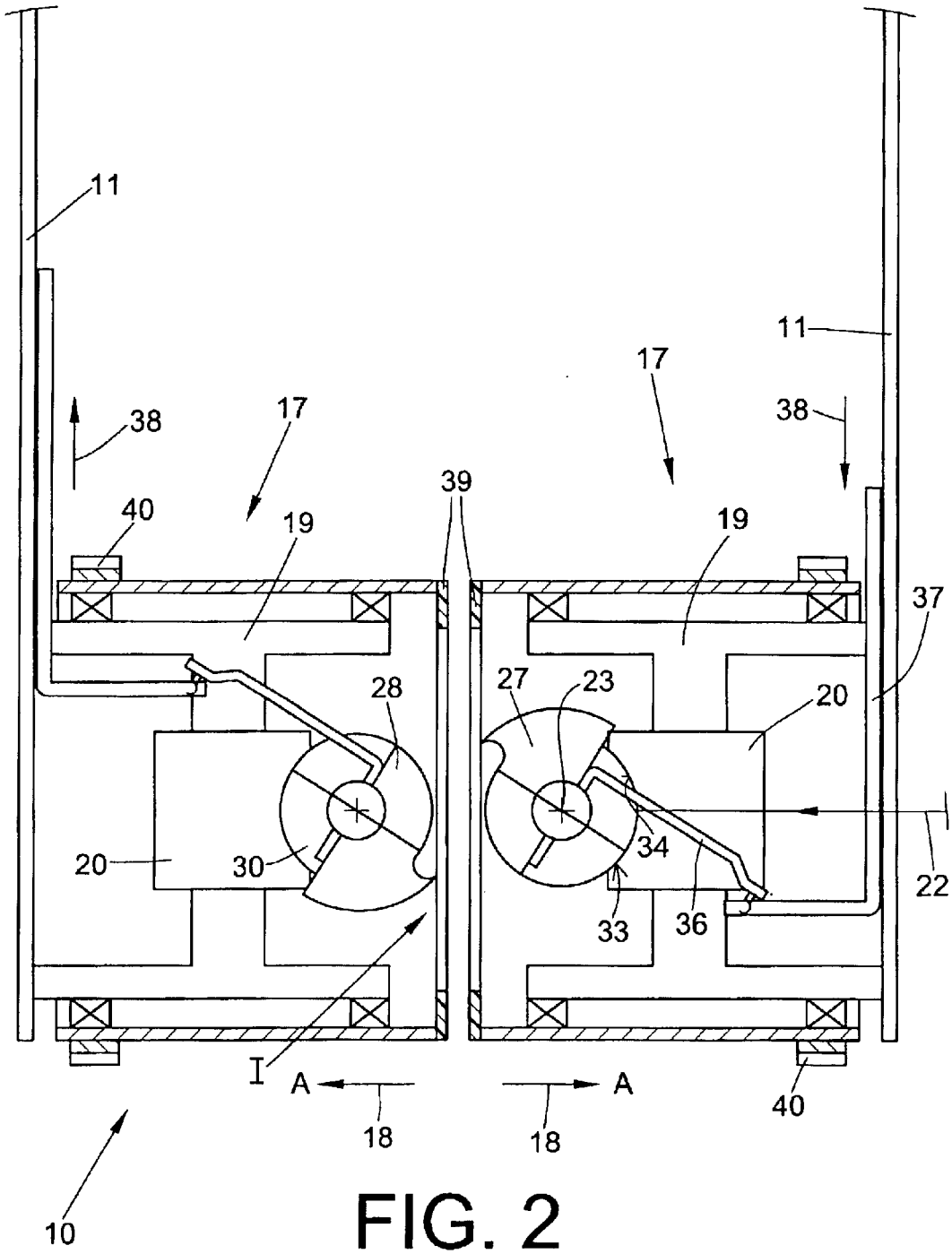
FIG. 2 is a top, partially sectional view of a yarn splicing device in its reception position in accordance with the present invention.
Figure 3:
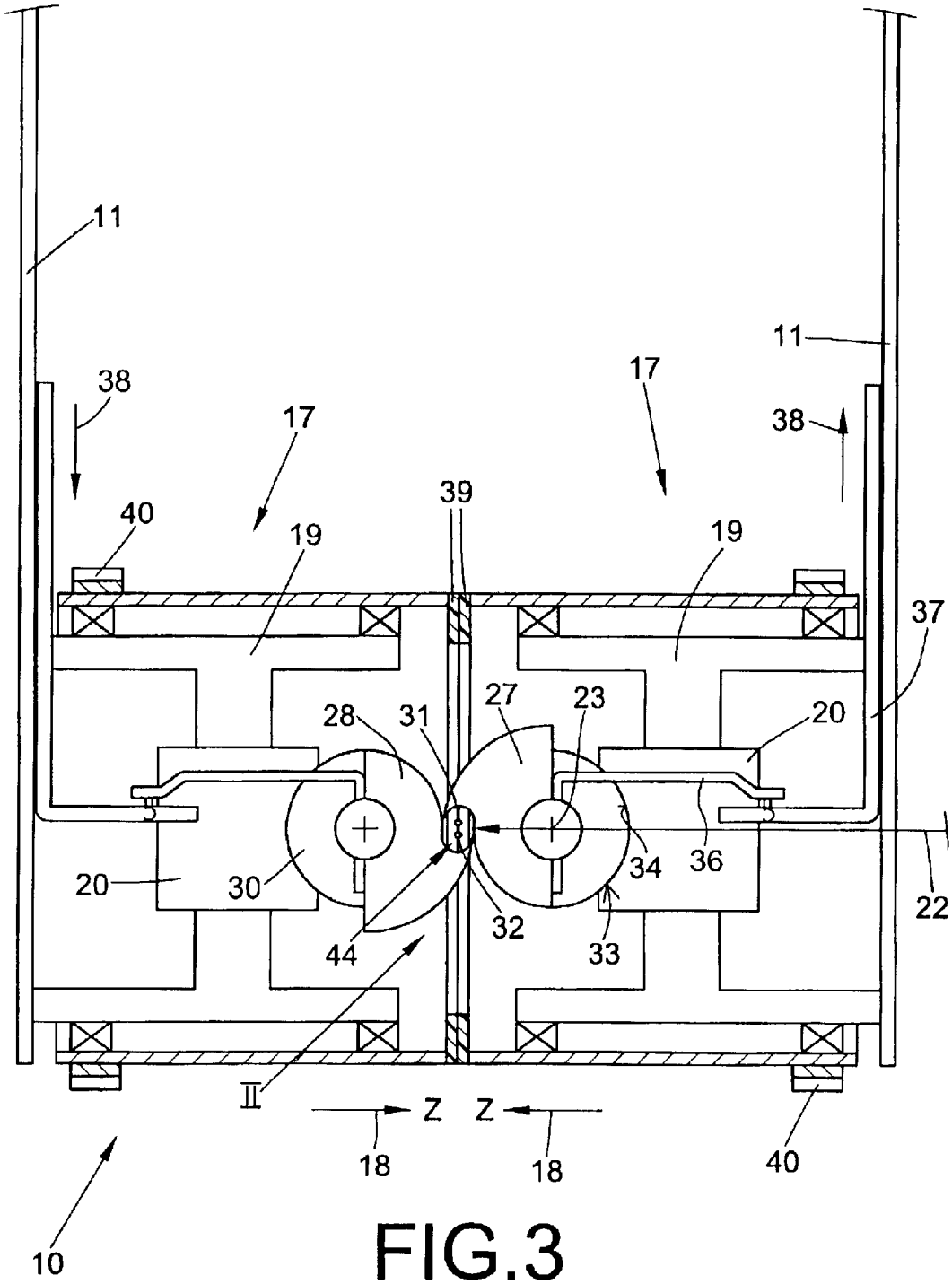
FIG. 3 is the yarn splicing device of FIG. 2 in its splicing position.

FIGS. 2 and 3 each show the yarn splicing device 10 in accordance with the present invention.

The yarn splicing device 10 is represented in its yarn reception position I in FIG. 2, while FIG. 3 shows the yarn splicing device 10 in its splicing position II.

The yarn splicing device 10 is substantially comprised of two identical component groups 17, each of which is fixed in place on a support arm 11. In this case, the support arms 11 can be displaced in the direction Z and the direction A by means of a drive mechanism 18, schematically indicated.

Each component group 17 has a base body 19, fixed in place on the support arm 11, with a connecting means 20 that can be charged pneumatically. In this case, each connecting means 20 is connected with a compressed air source (not shown) via a pneumatic line 22.

A prism element 27, or 28, is furthermore seated on the base body 19 and is rotatable to a limited extent on a pivot shaft 23. In this case, the prism elements 27 and 28 each have a prism body 27A, or 28A, as well as a rear, releasably arranged cover element 30.

The cover element 30 has a convexly arched sealing surface 33 that matches a correspondingly concavely arched sealing face 34 of the connecting means 20.

Figure 6:
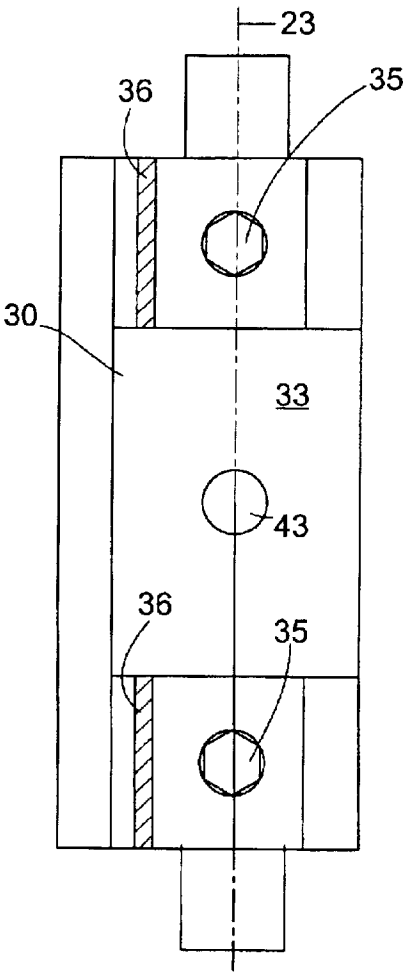
FIG. 6 is a rear view of the prism element of FIG. 4 (in accordance with the arrow VI).
Figure 5:
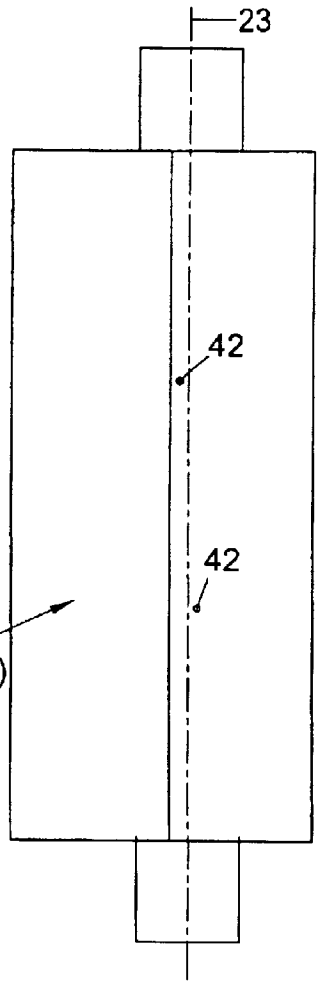
FIG. 5 is a front view of the prism element of FIG. 4 (in accordance with the arrow V).
Figure 4:
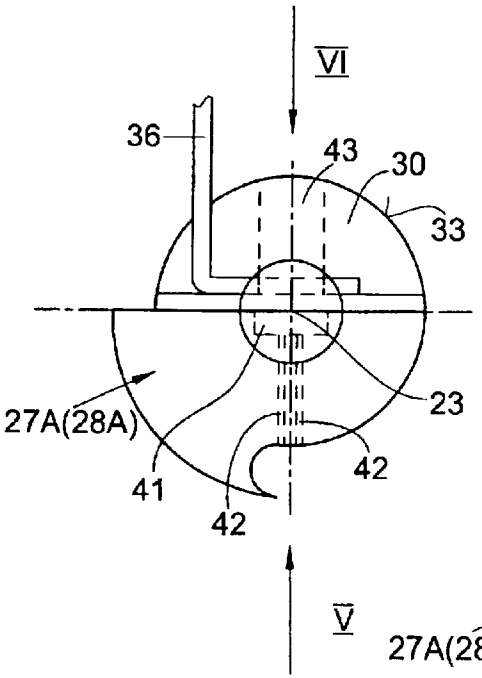
FIG. 4 is an overhead view of one of the prism elements of a yarn splicing device.
Figure 8:
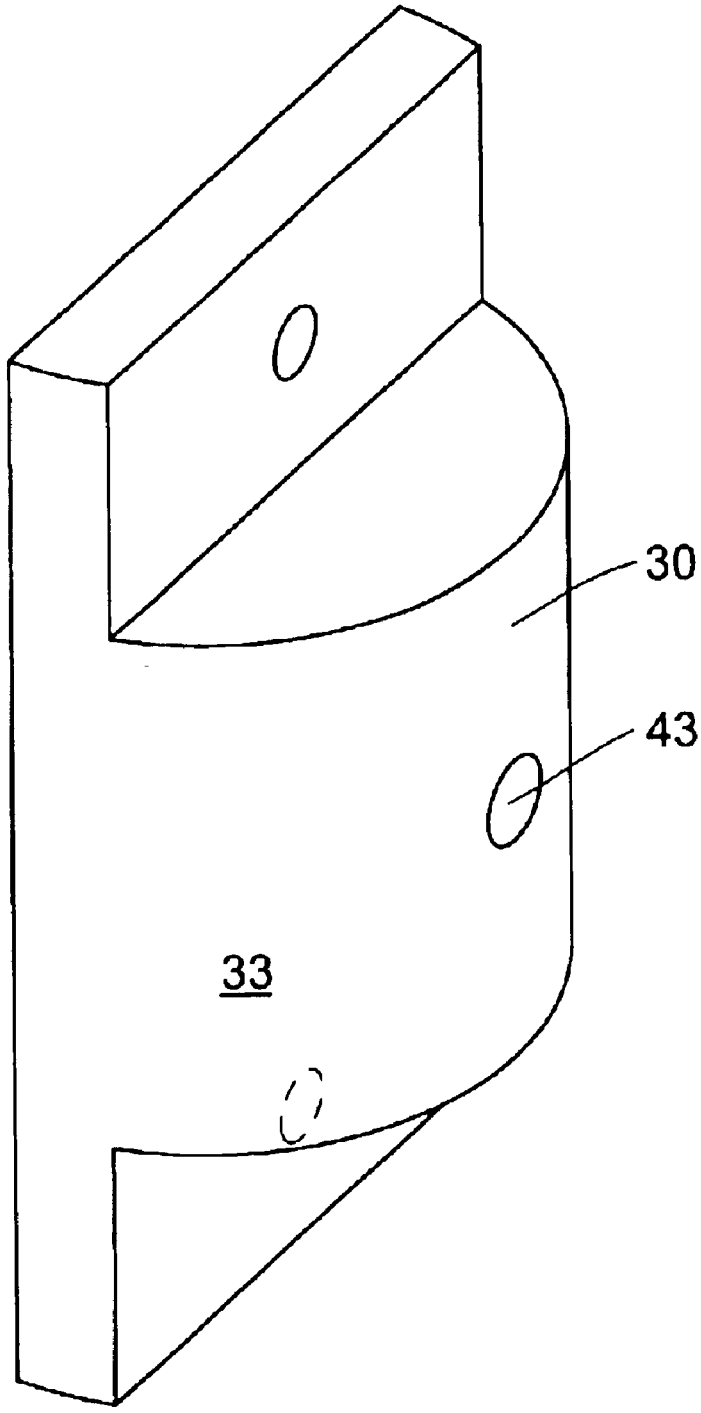
FIG. 8 is a perspective plan view of a cover element in accordance with the present invention.

As indicated by way of example in FIG. 6, the cover element 30 is releasably fastened, for example, by means of threaded bolts 35 on the prism body 27A, or 28A.

Pivot levers 36 are furthermore fixed in place by means of the threaded bolts 35. These pivot levers 36 act together with a corresponding drive lever 37 of a drive mechanism 38 (schematically indicated).

Furthermore, each component group 17 has a friction disk 39 that can be driven, for example, by means of a gear wheel drive.

Only a gear wheel 40 of this gear wheel drive, over which a toothed belt (not shown) is conducted, is indicated in FIGS. 2 and 3.

Figure 7:
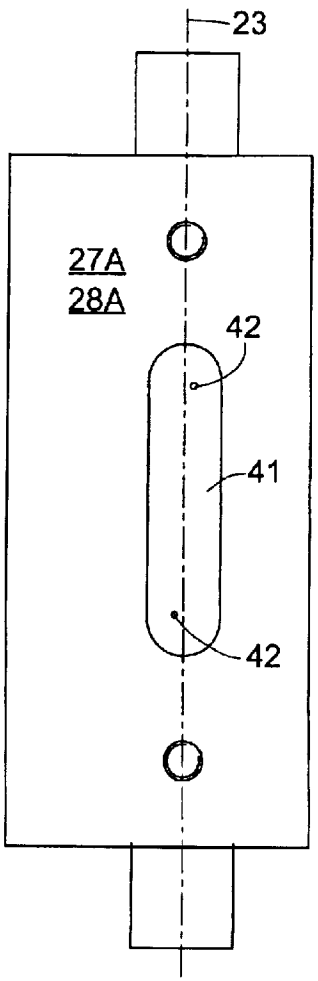
FIG. 7 is a view of the prism element of FIG. 6 without the cover element.

As can be seen particularly in FIG. 7, an air distribution channel 41, from which compressed air injection openings 42 branch, has been cut into each of the backs of the prism bodies 27A, and 27B.

In this case the air distribution channel 41 can be closed off by means of the cover element 30 that has a central air connection bore 43 in the area of its convexly arched sealing face 33.

However, only one of the many embodiments of the yarn splicing device of the present invention is shown in the drawings. Thus, there are numerous further variations in accordance with the present invention, each of which may differ in various details from the embodiment shown. However, these further variations of the yarn splicing device do not depart from the scope of the present invention.

For example, it is possible to equip only one of the prism elements 27 or 28 with a compressed air injection opening 42.

In this case, the oppositely located prism element constitutes a sort of cover element for the splicing channel 44.

In such case, only the connecting means 20, in which the prism element with the compressed air injection opening 42 slides, is connected via a pneumatic line 22 with a compressed air source (not shown).

In another variation, it can furthermore be provided that only one of the two component groups 17, into which the respective prism elements 27 and 28 are integrated can be displaced by means of a drive mechanism 18 in the direction Z, or A.

In such case, the oppositely arranged component group 17 is arranged to be stationary.

Other combinations and variations are also possible.

In another embodiment of the present invention, functioning of the yarn splicing device is represented in the drawings by means of an example of a cleaning cut.

During the "regular" winding operation, the yarn splicing device is in the so-called yarn reception position II indicated in FIG. 2.

Thus, the two component groups 17 of the yarn splicing device 10 are acted upon by the drive mechanism 18 such that the two friction disks 39 are spaced apart from each other. Furthermore, the prism elements 27 and 28 are pivoted in a clockwise direction via the drive mechanism 38, the drive lever 37 and the pivot lever 36.

In a known manner, in the case of a so-called cleaning cut, the top yarn 31 initially runs up on the cheese 15 while the bottom yarn 32 is customarily caught in a yarn tensioner.

Subsequently, the top thread 31 is picked up by the suction nozzle 12 and is positioned by means of the downward-pivoting suction nozzle 12 between the prism elements 27 and 28 of the yarn splicing device 10 as indicated in FIG. 1. Subsequently, or simultaneously, the gripper tube 25 picks up the bottom thread 32 from the yarn tensioner and positions the bottom thread 32 also between the prism elements 27 and 28 that are in the yarn reception position I of the yarn splicing device 10.

Thereupon, the yarn splicing device 10 is closed. Thus, the yarns 31 and 32 are clamped between the friction disks 39 of the yarn splicing device 10, as indicated in FIG. 3.

Subsequently, the prism elements 27 and 28 are pivoted in a counterclockwise direction by means of the drive mechanism 38, and in the process, form a splicing channel 44 between them.

Thereafter, the yarn ends 31 and 32 are prepared for the splicing process.

Thus, the yarn ends 31 and 32 are freed, at least partially, of their yarn twist by the friction disks 39 driven in opposite directions. The free yarn ends are then pulled off and are disposed of by means of the suction nozzle 12, or the gripper tube 25.

Subsequently, the yarn ends of the yarn 31 and 32 positioned in the splicing channel 44 are charged with splicing air through the compressed air injection openings 42 and are twisted in the process, so that an almost finished yarn-like yarn connection is created.

At the end, the prism elements 27 and 28 are returned from the splicing position II into the yarn reception position I, and the yarn splicing device 10 is opened again.

The now spliced yarn returns into its "normal" yarn running path, and the spinning process is continued.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A yarn splicing device comprising two rotatably seated prism elements, each pivotable between a non-splicing position wherein the prism elements are disposed for receiving two yarn ends to be spliced and a splicing position wherein the prism elements define therebetween a splicing channel adapted to be charged with compressed air for pneumatic connection of the yarn ends and at least one of the prism elements has a compressed air injection opening.

2. The yarn splicing device in accordance with claim 1, wherein the compressed air injection opening branches from an air distribution channel formed in each of the prism elements.

3. The yarn splicing device in accordance with claim 2, wherein the compressed air injection opening terminates tangentially in the splicing channel.

4. The yarn splicing device in accordance with claim 1, wherein the prism elements are identical and each has a compressed air injection opening.

5. The yarn splicing device in accordance with claim 1, wherein at least one of the prism elements comprises a prism body and a rear, releasably arranged cover element.

6. The yarn splicing device in accordance with claim 5, wherein the cover element has a convexly rounded sealing face, in which an air connection bore is arranged such that the sealing face cooperates with a concavely rounded sealing face of a stationary connecting means that can be charged with compressed air.

7. The yarn splicing device in accordance with claim 1, wherein the prism element is pivotably seated on a base body of the yarn splicing device and can be acted upon by a drive mechanism.

8. The yarn splicing device in accordance with claim 7, wherein a step motor is provided as a drive mechanism for the prism element that can be controlled by a work station computer.

* * * * *